US005373130A

United States Patent [19]

Barrault et al.

[11] Patent Number: 5,373,130

[45] Date of Patent: Dec. 13, 1994

[54] SELF-EXTINGUISHING EXPANSION SWITCH OR CIRCUIT BREAKER

[75] Inventors: Michel Barrault, St. Ismier; Georges Bernard, St. Egreve; Stéphan Rowe, Crolles; Pierre Leclercq, Moirans; Paul Glenat, St. Martin D'Heres; Odile Filleau, St. Nazaire Les Eymes, all of France

[73] Assignee: Merlin Gerin, France

[21] Appl. No.: 77,912

[22] Filed: Jun. 18, 1993

[30] Foreign Application Priority Data

Jun. 30, 1992 [FR] France ..... 92 08138

[51] Int. Cl.[5] ..... H01H 33/18; H01H 33/915

[52] U.S. Cl. ..... 200/147 R; 200/148 R; 200/148 B

[58] Field of Search ..... 200/146 R, 147 R, 148 R, 200/148 A, 148 B

[56] References Cited

U.S. PATENT DOCUMENTS

| | | | |
|---|---|---|---|
| 4,900,882 | 2/1990 | Bernard et al. | 200/147 R |
| 5,001,313 | 3/1991 | Leclercq et al. | 200/148 B |
| 5,057,655 | 10/1991 | Kersusan et al. | 200/148 B |

FOREIGN PATENT DOCUMENTS

| | | | |
|---|---|---|---|
| 0150079 | 7/1985 | European Pat. Off. | H01H 33/98 |
| 0298809 | 1/1989 | European Pat. Off. | H01H 33/915 |
| 2459543 | 1/1981 | France | H01H 33/04 |
| 2623657 | 5/1989 | France | H01H 33/74 |

*Primary Examiner*—J. R. Scott

*Attorney, Agent, or Firm*—Parkhurst, Wendel & Rossi

[57] ABSTRACT

A self-extinguishing expansion switch or circuit breaker, including an extinguishing chamber and an expansion chamber connected by a duct. The extinguishing chamber is positioned above the expansion chamber. An axially movable tube supports a movable arcing contact which is cooperable with a stationary arcing contact. The axially movable tube separates axially from a conducting tube supported by an operating rod such that the circuit breaker is in an isolated position beyond an open position.

8 Claims, 3 Drawing Sheets

SELF-EXTINGUISHING EXPANSION SWITCH OR CIRCUIT BREAKER

BACKGROUND OF THE INVENTION

The present invention relates to a self-extinguishing expansion switch or circuit breaker for high or medium voltages.

It is state-of-the-art, for example according to the document EP-A-0,298,809, to provide a circuit breaker with a sealed enclosure filled with a high dielectric strength gas and containing one or more poles of the circuit breaker, each pole comprising:

an extinguishing chamber having a revolution surface sealed off tightly at opposite ends by end-plates;

a pair of tubular arcing contacts, arranged coaxially in said extinguishing chamber and each passing through one of the end-plates to make the extinguishing chamber communicate, in the separated position of the arcing contacts, with the enclosure forming an expansion chamber by the gas outflow ducts constituted by the tubular arcing contacts;

a coil or permanent magnet supported by one of the end-plates inside the extinguishing chamber so as to create in the separation zone of the arcing contacts a magnetic field for blowout in rotation of an arc drawn between the separated arcing contacts;

a pair of main contacts located outside the extinguishing chamber and arranged to open before separation of the arcing contacts takes place when an opening operation of the circuit breaker is performed.

A circuit breaker of this kind with self-extinguishing expansion and rotating arc combines pneumatic blowout of the arc by expansion gases with magnetic blowout of the arc in rotation on annular electrodes. This breaking method can be used in medium or high voltage circuit breakers and presents the advantage of requiring low operating energies.

It does however present some drawbacks, especially when operation is desired in the high voltage field.

A first drawback is of purely dimensional nature. If we consider a pole of this state-of-the-art circuit breaker (e.g., see FIG. 1 of the above-mentioned document EP-A-0,298,809) it can be noted that the extinguishing chamber, itself of relatively small dimensions, is surrounded by a rather voluminous insulating enclosure. It is in fact necessary, for this state-of-the-art achievement, to arrange a sufficient expansion volume both above and below the extinguishing chamber, and moreover to provide a fairly wide annular communication corridor between these two, upper and lower, expansion volumes. The dimensions of the tubular insulating part, generally made of porcelain, of the sealed enclosure containing each pole of the circuit breaker are subsequently large which, especially for high voltages, is particularly disadvantageous in terms of space requirements and cost price.

Another drawback lies in the fact that, when the circuit breaker pole is open, all the voltage is applied via the insulating ring which forms one of the two end-plates of the extinguishing chamber, the other end-plate forming part of a conducting bell which is closed by this insulating ring. This does not cause great problems for a medium voltage for example of about 10 kilovolts, but it can easily be understood that it becomes more difficult to achieve with a high voltage of about 200 kilovolts for example.

Finally, the fact that the extinguishing chamber is positioned well inside the insulating enclosure makes it unsuitable for various advantageous possibilities of mechanical fixing.

SUMMARY OF THE INVENTION

The object of the invention is to overcome these drawbacks. It relates for this purpose to a self-extinguishing expansion switch or circuit breaker, each pole of this switch or circuit breaker comprising:

on the one hand an extinguishing cheer, a first end-plate of which is conducting and forms a first current terminal pad which is connected, in this extinguishing chamber, to a stationary annular arcing contact, and the other end-plate of which is insulating and has passing through it a coaxial and axially movable conducting tube, the free end of this tube supporting the movable annular arcing contact which is the conjugate of the stationary arcing contact:

and on the other hand a sealed expansion chamber, of much larger dimensions, which is tightly connected to this extinguishing chamber by at least one duct designed to enable the ionized gases to migrate, when an arc is created on opening, from this extinguishing chamber to this expansion chamber;

this expansion chamber being coaxial to the extinguishing chamber and containing the main contacts of the pole, comprising a stationary contact which is connected to the conducting end-plate of the extinguishing chamber and a movable contact which is normally designed to be connected to said movable conducting tube, mechanical means being provided to open these main contacts before the arcing contacts, this switch or circuit breaker being characterized in that:

the extinguishing chamber is not placed inside the expansion chamber, but in the extension of and above the latter; and the movable conducting tube which supports the movable arcing contact electrode at its free end is designed, in the closed position and when it is withdrawn to its open position with the arc finally extinguished, to be in electrical contact with a second coaxial conducting tube, these two tubes being arranged and means being provided to separate the tubes electrically and axially from one another, when the movable tube is further withdrawn beyond this open position with the arc finally extinguished, thus achieving between them a sufficiently large gas gap so that the voltage is in fact applied via the external tubular insulating part which constitutes the expansion chamber enclosure, and not via the insulating annular end-plate of the extinguishing chamber.

Preferably, the diameters of the expansion chamber and extinguishing chamber are practically the same, so that these two chambers form practically both together a long, sealed enclosure of tubular shape comprising two end-plates which constitute the two opposite current terminal pads.

BRIEF DESCRIPTION OF THE DRAWINGS

Anyway, the invention will be fully understood and its other advantages and features will become more clearly apparent from the following description of two illustrative embodiments of the invention, given as non-restrictive examples only, with reference to the accompanying schematic drawing in which.

DESCRIPTION OF THE PREFERRED EMBODIMENT

Figure 1:
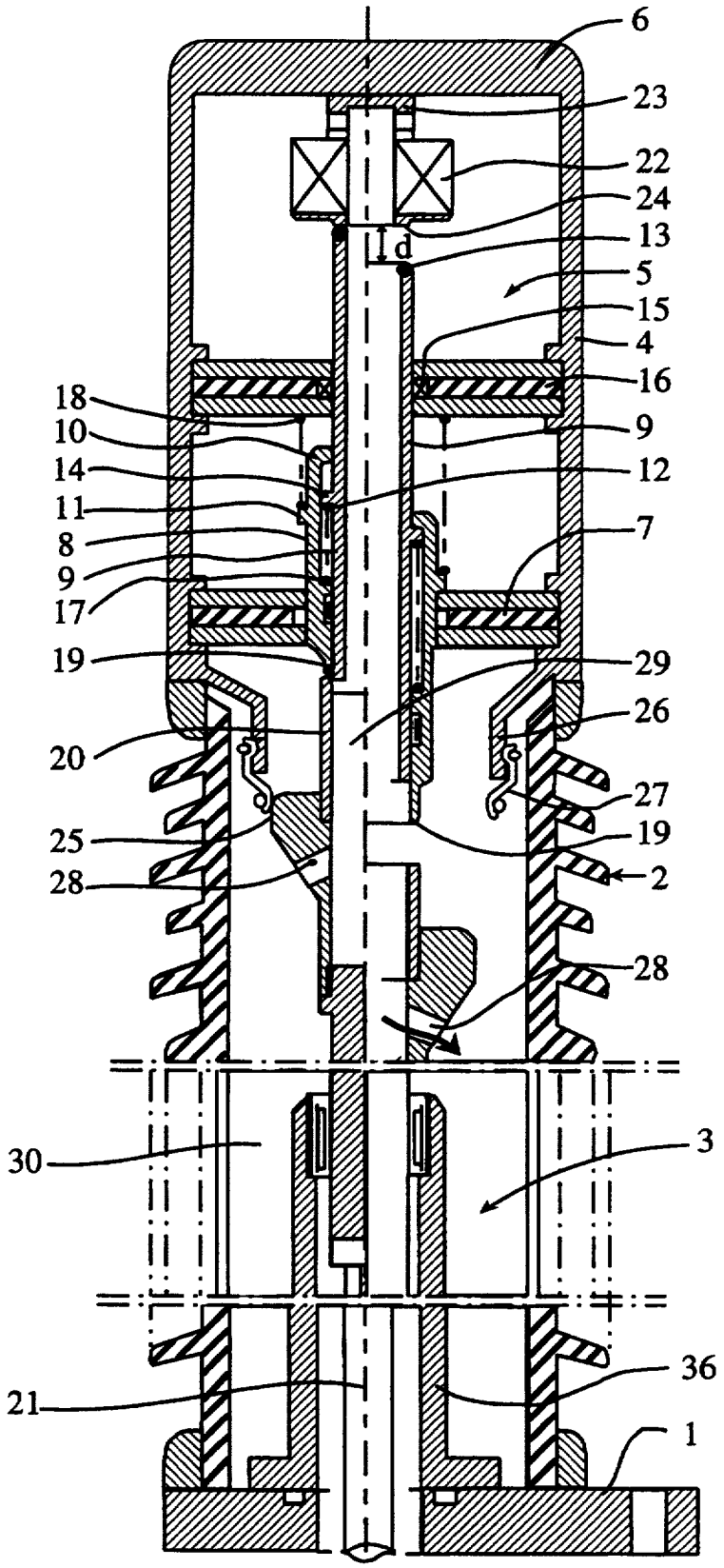
FIG. 1 is a schematic axial sectional view of a first embodiment of a circuit breaker according to the invention, the left half-section representing this circuit breaker in the closed position and the right half-section representing this circuit breaker in the course of the ultimate opening phase.

Referring to FIG. 1, one of the three poles of this circuit breaker is represented.

This device comprises a horizontal metal base 1 which forms the first current pad or terminal and which tightly supports a long cylindrical housing 2 made of porcelain or any other suitable insulator which houses of the expansion chamber 3 of this self-extinguishing expansion circuit breaker pole.

The other end of the long cylindrical housing 2 is tightly covered by a coaxial cylindrical metal bell 4 the upper part of which forms the housing of the extinguishing chamber 5 of this circuit breaker pole, and which is appreciably of the same diameter as the cylindrical housing 2.

The horizontal upper metal end-plate 6 of the cylindrical bell 4, in the form of a thick flat disk, forms the second current pad or metal base, opposite the other terminal 1.

The internal space of the bell 4 is separated from the expansion chamber 3 by an annular insulating spacer 7, which may be leaktight, whose central circular orifice has passing through it coaxially an assembly of two sliding telescopic metal tubes, comprising:

a small external sliding tube 8 whose top end forms a circular radial shoulder 10 and which comprises, roughly in its middle, a circular collar 11; and a longer internal sliding tube 9 whose upper annular edge supports the movable arcing contact electrode 13 and which is also provided with a collar 14 located under the shoulder 10 to be able to be engaged with the latter.

The sliding tube 9, which may be metal, also passes tightly by means of a seal 15 through another insulating annular spacer 16 which constitutes the other end-plate of the extinguishing chamber 5.

Between the collar 14 of the sliding tube 9 and an internal edge 17 of the sliding tube 8 there is provided a repulsion spring 12 which tends to separate tubes 8 and 9 longitudinally from one another.

In addition, another repulsion spring 18 is placed between the collar 11 of the sliding tube 8 and the lower face of the insulating spacer 16, in order to push the sliding tube 8 downwards and consequently to maintain its lower annular edge 19 in mechanical and electrical contact against the upper annular edge of a metal tube 20 which is supported by the operating rod 21 of this circuit breaker pole, itself maintained by a metal tube 36 in which it slides.

The extinguishing chamber 5 is conventional, and comprises an annular, coaxial induction coil 22 which is fixed, by a tubular metal transition 23, to the internal face of the metal end-plate 6 of the extinguishing chamber 5, and which supports the annular stationary arcing electrode 24, conjugate to the movable arcing electrode 13.

In very conventional manner, the metal tube 20 has a bulge 25 which forms the movable main contact 25 of the circuit breaker and which is, in the closed position represented in the left half-section of FIG. 1, connected to the stationary main contact 26 by a flexible annular grip 27.

The metal tube 20 has radial openings 28 through which internal space 29 of tube 20 communicates with the internal space 30 of the expansion chamber.

The operation of this circuit breaker will now be described referring also to FIG. 2.

At the outset (point A in FIG. 2), the circuit breaker is in its "closed" position represented in the left half-section of FIG. 1.

The operating rod 21 is then drawn downwards by conventional mechanical means which are not represented. The tubes 20 and 8 then start to move downwards, whereas the tube 9, held in place by the spring 12, remains immobile for the moment.

Figure 2:
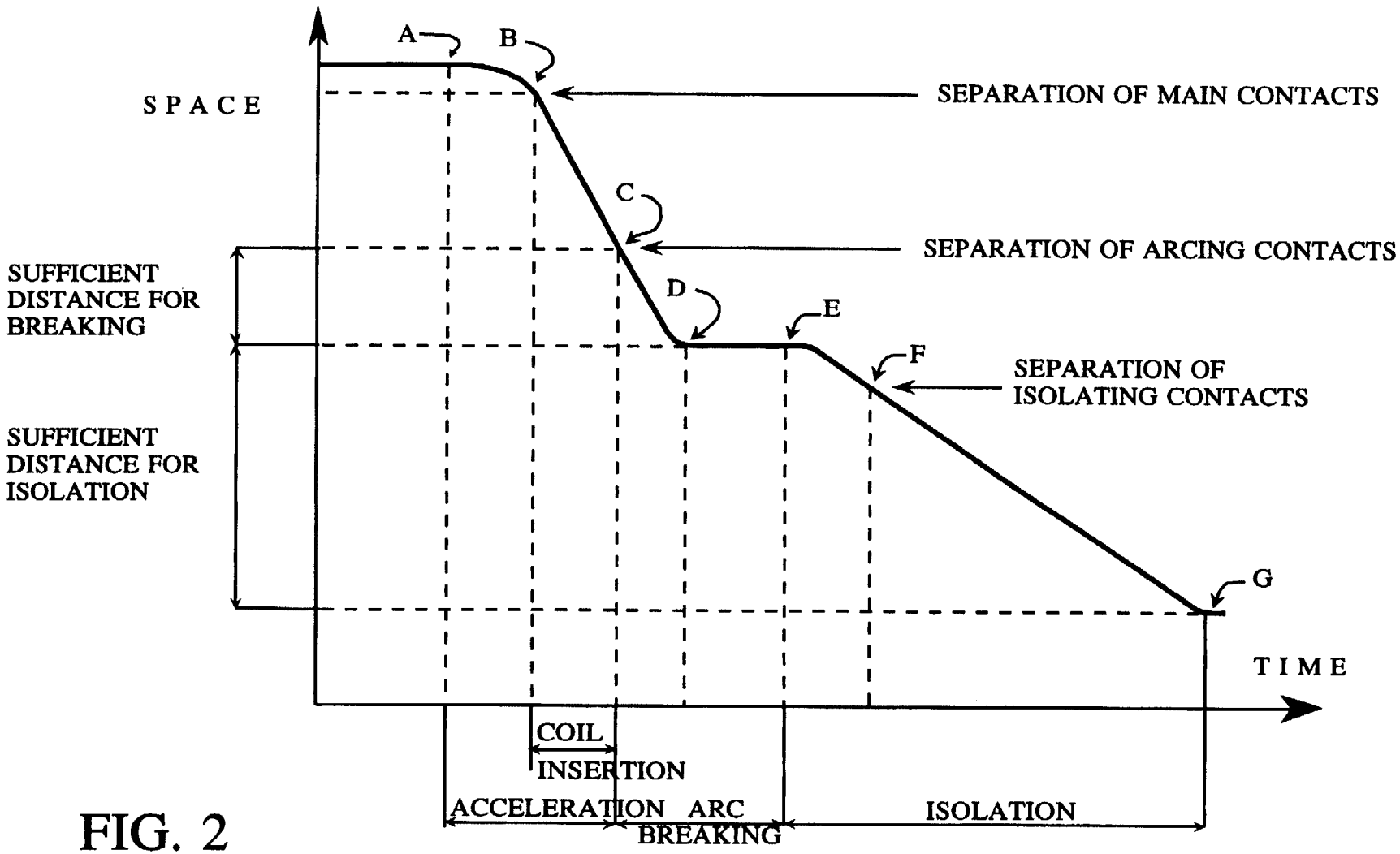
FIG. 2 is a kinematic "space-time" curve of operation of this circuit breaker on opening.

The movable main contact 25 is then released, at point B in FIG. 2, from the grip 27, resulting in standard manner in disconnection of the main contacts 25, 26, without creation of an arc since the arcing electrodes 13 and 24 are still in contact. The coil 22 is then connected in the sole current flow serial circuit which is made up of metal end-plate 6, the link 23, the coil 22, the arcing electrodes 24 and 13, the three tubes 9, 8, 20, the metal part downstream from the rod 21 and its securing and sliding tube 36, and finally the metal base 1.

When, at the point C in FIG. 2, the shoulder 10 has come up against the conjugate collar 14, the tube 9 is drawn in turn and moves downwards resulting in separation of the arcing electrodes 24 and 13.

An arc then flashes over between these electrodes 24 and 13, giving rise to ionization and pressurization, in the extinguishing chamber 5, of the Sulfur Hexafluoride, or other high dielectric strength gas, which conventionally fills the extinguishing chamber 5 and also the expansion chamber 3. At the same time, this arc is made to rotate by the magnetic field created by the current which is flowing in the coil 22, which, by moving the arc root, enhances its extinction. This extinction is, in state-of-the-art manner, moreover facilitated by the fact that this ionized and pressurized gas flows, via the internal space 29 of the coaxial conducting tubes and via the orifices 28, by self-expansion to the internal space 30 of the chamber 3.

As can be seen in FIG. 2, a pause of for example 20 milliseconds is made, slightly before the point D is reached where the collar 11 comes up against the upper face of the spacer 7, which corresponds to the arc extinguishing distance (d), to then wait for complete extinction of the arc, achieved at the point E.

The downward traction movement of the rod 21 is then resumed, so that when the tube 8 reaches its end of travel, separation of the contacts occurs, which are formed by the lower annular edge 19 of the tube 8 and the upper annular edge of the tube 20 (point F in FIG. 2).

The rod 21 is then drawn downwards to the maximum (point G) which enables a sufficient insulation distance to be achieved between the tubes 8 and 20.

It should be noted that the cylindrical housing 2 here has a fairly small diameter, practically equal to that of the extinguishing chamber 5; the assembly in fact forms a long narrow tube, whose lateral dimension is small.

Figure 3:
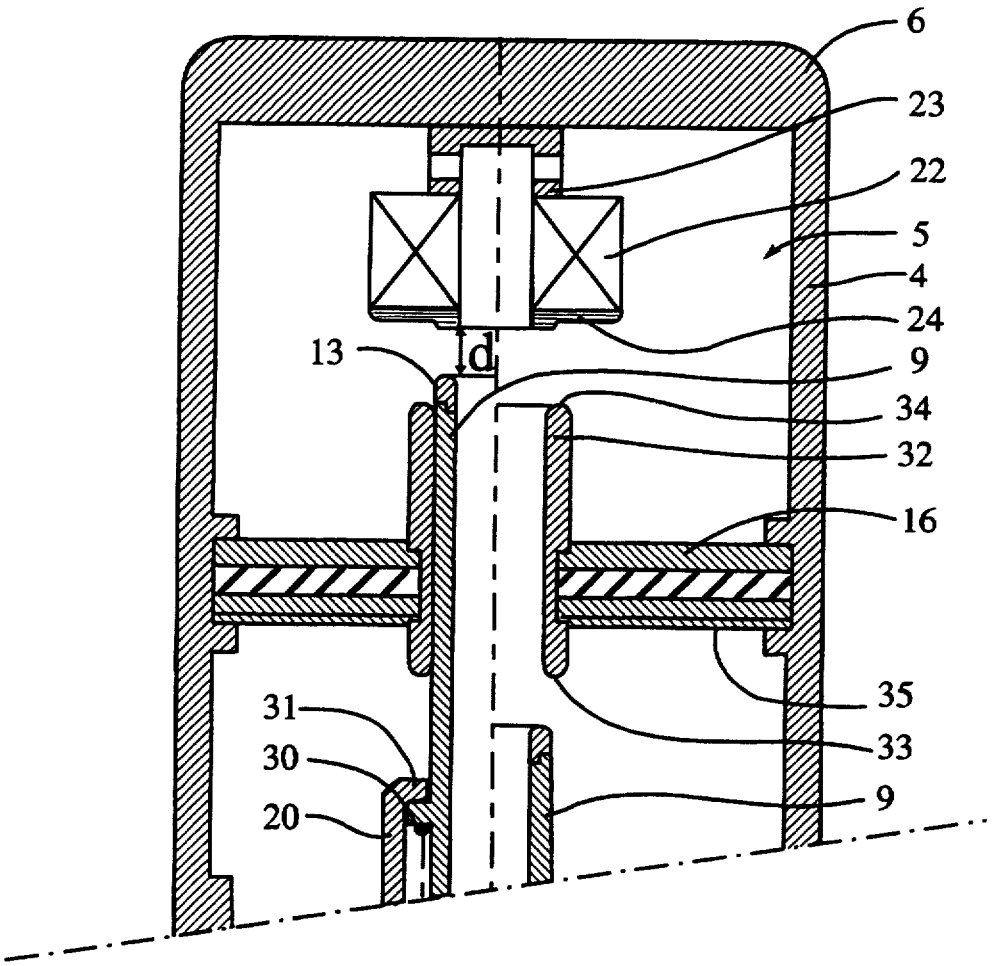
FIG. 3 is a similar view to FIG. 1 of the upper part of another embodiment of a circuit breaker according to the invention.

An alternative embodiment is represented in FIG. 3. In this case, the tube 8, spring 18 and spacer 7 of FIG. 1 no longer exist, and the tube 20 comprises, as for the device according to the above-mentioned document EP-A-0,298,809, a bearing face (not represented) of a spring repelling the tube 9 upwards, and a catch 31 for delayed downwards driving of this tube 9, which enables the main contacts to be opened before the arcing contacts 24 and 13 in the conventional manner.

The annular insulating spacer 16 on the other hand maintains in its center a metal sheathing tube 32 whose lower edge 33 appreciably overshoots the level of the lower face 35 of the insulating end-plate 16, and whose upper edge 34 is at a distance from the stationary arcing electrode 24 which is at least equal to the arc breaking distance (d).

This tube 32 has an internal diameter equal to the external diameter of the movable conducting tube 9, so that the movable tube 9 can slide in the sheathing tube 32. Means are provided to guarantee their positive electrical connection.

In the left half-section of FIG. 3, the tube 9 is represented at the arc breaking distance (d). When the arc has been extinguished, this tube 9 continues to be withdrawn until mechanical and electrical separation of the tubes 32 and 9 is achieved, as in the right-hand half of this figure. The voltage is then no longer applied to the tube 32, which is electrically insulated. By withdrawing the tube 9 even further, a sufficient insulation distance is guaranteed as before.

The invention is naturally not limited to the two embodiments which have just been described, and other alternative embodiments are envisageable without departing from the same spirit, in particular blowing the gas through the coil, or using magnets. It is of great interest for the high voltage field, but its application in medium voltage is in no way to be excluded.

We claim:

1. A self-extinguishing circuit breaker, comprising:

an extinguishing chamber including first and second end plates, said first end plate being electrically conductive, said second end plate being electrically insulative, and a stationary arcing contact electrically connected to said first end plate;

an axially movable first conducting tube which passes through an orifice in said second end plate of said extinguishing chamber and extends towards said stationary arcing contact, a first end of said first conducting tube including a movable arcing contact which faces said stationary arcing contact;

a sealed expansion chamber having a first end which is sealingly secured to said extinguishing chamber and a second end which is closed by a conducting end plate, said expansion chamber containing stationary and movable main contacts, and a duct to allow gas communication between said extinguishing and expansion chambers, said stationary main contact being electrically connected to said first end plate of said extinguishing chamber, said movable main contact being mechanically secured to a movable operating rod and electrically connected to said conducting end plate;

an axially movable second conducting tube extending from said movable main contact towards said first conducting tube; and connector means for connecting said first and second conducting tubes to each other, whereby said first and second conducting tubes are in electrical contact with each other in open and closed positions of the circuit breaker, and axially separated from each other so as to be electrically disconnected in an isolated position of the circuit breaker, said closed position being defined by said movable and stationary arcing contacts, and said movable and stationary main contacts being in electrical contact with each other, respectively, said open position being defined by said movable and stationary arcing contacts, and said movable and stationary main contacts being separated from each other, respectively, and said first and second conducting tubes being in electrical contact with each other, and said isolated position being defined by said movable and stationary arcing contacts, said movable and stationary main contacts, and said first and second conducting tubes being separated from each other.

2. The circuit breaker of claim 1, wherein said expansion and extinguishing chambers are substantially cylindrical and have substantially the same diameter, such that said expansion and extinguishing chambers form an extended tubular shaped structure, said first end plate of said extinguishing chamber and said conducting end plate of said expansion chamber forming current terminal pads.

3. The circuit breaker of claim 1, wherein said connector means comprises an auxiliary tube electrically connected to said first conducting tube, and a biasing means for biasing said auxiliary tube towards second conducting tube, said first and second conducting tubes and said auxiliary tube being coaxial with each other.

4. The circuit breaker of claim 3, wherein said connector means further comprises stop means to prevent said biasing means from biasing said auxiliary tube towards said second conducting tube in the isolated position of the circuit breaker, said auxiliary tube being slidingly fitted around said first conducting tube.

5. The circuit breaker of claim 1, wherein said extinguishing chamber further comprises a housing connecting said first and second end plates to each other, said housing being metallic, and wherein said stationary main contact is secured to said housing.

6. The circuit breaker of claim 1, wherein said expansion chamber is delimited by a housing secured to said conducting end plate, said housing being comprised of porcelain.

7. The circuit breaker of claim 1, further comprising a coil for generating a magnetic field to rotate and extinguish an arc drawn between the stationary and movable arcing contacts upon separation thereof in the extinguishing chamber.

8. A self-extinguishing circuit breaker, comprising:

an extinguishing chamber including first and second end plates, said first end plate being electrically conductive, said second end plate being electrically insulative, and a stationary arcing contact electrically connected to said first end plate;

an axially movable first conducting tube which passes through an orifice in said second end plate of said extinguishing chamber and extends towards said stationary arcing contact, a first end of said first conducting tube including a movable arcing contact which faces said stationary arcing contact;

a conductive sheathing tube secured to said second end plate of said extinguishing chamber and extending through said orifice, said first conducting tube slidably extending through said sheathing tube, an internal diameter of the sheathing tube being substantially equal to an external diameter of the first conducting tube such that said sheathing tube and said first conducting tube are electrically connected to each other, said sheathing tube having a first end spaced apart from said stationary arcing contact;

a sealed expansion chamber having a first end which is sealingly secured to said extinguishing chamber and a second end which is closed by a conducting end plate, said expansion chamber containing stationary and movable main contacts, and a duct to allow gas communication between said extinguishing and expansion chambers, said stationary main contact being electrically connected to said first end plate of said extinguishing chamber, said movable main contact being mechanically secured to a movable operating rod and electrically connected to said conducting end plate;

an axially movable second conducting tube extending from said movable main contact and being connected to said first conducting tube, said circuit breaker being switchable between closed, open and isolated positions, said closed position being defined by said movable and stationary arcing contacts, and said movable and stationary main contacts being in electrical contact with each other, respectively, said open position being defined by said movable and stationary main contacts being separated from each other, and said movable and stationary arcing contacts being separated from each other by an arc breaking distance (d), and said isolated position being defined by said movable and stationary main contacts being separated from each other, and said movable arcing contact being axially displaced to be separated from said sheathing tube, and separated from said stationary arcing contact by a distance greater than said arc breaking distance (d).

* * * * *